US008217851B2

(12) United States Patent
Cheng

(10) Patent No.: US 8,217,851 B2
(45) Date of Patent: Jul. 10, 2012

(54) DUAL BAND ANTENNA

(75) Inventor: Pi-Hsi Cheng, Zhubei (TW)

(73) Assignee: Arcadyan Technology Corp., Hsinchu (TW)

( * ) Notice: Subject to any disclaimer, the term of this patent is extended or adjusted under 35 U.S.C. 154(b) by 107 days.

(21) Appl. No.: 12/152,511

(22) Filed: May 14, 2008

(65) Prior Publication Data

US 2009/0073050 A1 Mar. 19, 2009

(30) Foreign Application Priority Data

Sep. 14, 2007 (TW) ..... 96134599 A

(51) Int. Cl.
*H01Q 1/36* (2006.01)
*H01Q 1/24* (2006.01)

(52) U.S. Cl. ..... 343/846; 343/702

(58) Field of Classification Search ..... 343/700 MS, 343/702, 846, 848
See application file for complete search history.

(56) References Cited

U.S. PATENT DOCUMENTS 5,103,238 A * 4/1992 Mahnad ..... 343/796
6,222,496 B1 4/2001 Liu
6,563,466 B2 5/2003 Sadler et al.
6,644,555 B1 * 11/2003 Berney ..... 235/492
6,894,647 B2 5/2005 Jenwatanavet
7,023,386 B2 * 4/2006 Habib et al. ..... 343/700 MS
7,446,717 B2 * 11/2008 Hung et al. ..... 343/702
2004/0174305 A1 9/2004 Kuo et al.
2005/0243006 A1 11/2005 Lin et al.
2005/0259024 A1 11/2005 Hung et al.
2006/0164306 A1 7/2006 Chang et al.
2006/0262016 A1 11/2006 Hung et al.
2007/0120753 A1 5/2007 Hung et al.

FOREIGN PATENT DOCUMENTS

TW I247452 1/2006
TW 1256749 6/2006
WO 0003452 A1 1/2000

* cited by examiner

*Primary Examiner* — Michael C Wimer
(74) *Attorney, Agent, or Firm* — Haverstock & Owens LLP

(57) ABSTRACT

A dual band antenna is provided. The dual band antenna includes a radiating element, a grounding element, and a connection element. The radiating element has a first radiating portion and a second radiating portion, wherein the second radiating portion extends from the first radiating portion in a first direction parallel to the grounding element. The connecting element extends in a second direction and is connected between the radiating element and the grounding element, wherein the connecting element has a first end connected to the radiating element and a second end connected to the grounding element with an including angle between 0° and 90°, and a configuration including the connecting element, the radiating element and the grounding element has a Z-like shape.

13 Claims, 5 Drawing Sheets

DUAL BAND ANTENNA

FIELD OF THE INVENTION

The present invention relates generally to an antenna and, in particular, to a planar inverted-F antenna (PIFA) which is capable of operation in multi-frequency bands.

BACKGROUND OF THE INVENTION

In Recent years, wireless communication devices, such as cellular phones, notebook computers, and the like are more popular to promote the importance of antennas that are capable of transmitting and receiving signals. Therefore, antennas with simple structure have become increasingly popular, especially ones which operate on the principle of inverted-F antennas.

U.S. Pat. No. 6,812,892 discloses a conventional antenna. Please refer to FIG. 1, which illustrates a conventional antenna 1' including a radiating portion 2', a connection portion 3', and a ground portion 4'. The connection portion 3' including a first segment 31', a second segment 32', and a third segment 33' is connected to the radiating portion 2', the ground portion 4', and a feeder line 5'. Transmitting signals from the feeder line 5' passes through an input point P' on the first segment 31' to radiating portion 2'. Thus, the input point P' divides the radiating portion 2' into a first radiating portion 21' and a second radiating portion 22', so that the radiating portion 2' forms two PIFAs operating in a higher and a lower frequency bands.

The main characteristic of conventional antenna 1' is based on matching impedance and resonating in specific frequency bands, so that the connection portion 3' has a complex structure. Referring to FIG. 1, there are one turn between the first segment 31' and the second segment 32', and the other turn between the second segment 32' and the third segment 33'. The two-turn structure causes the connection portion 3' to have a complex stair-like structure.

The feeder line 5' which is a coaxial cable includes a core line 51' and a metal braided layer 52'. The core line 51' is connected to the input point P' of the first segment 31'. The input point P' is adjustable, but its position is still restricted on the first segment 31'. Furthermore, the metal braided layer 52' is soldered on the ground portion 4' for grounding the antenna 1'. The distance between the solder point of the metal braided layer 52' and the input point P' is predetermined to achieve a desired matching impedance for two distinct frequency bands.

It is noted that the efficiency of the conventional antenna 1' depends on the structure of the connection portion 3' and the input point P'. However, the connection portion 3' with a complex stair-like structure is not only restricts the position of the input point P', but also the bandwidth of the conventional antenna 1'.

Accordingly, there should be an antenna for solving the above problems, simplifying a structure, and having a wider bandwidth.

Therefore, it is tried to rectify those drawbacks and provide an antenna that has a simpler structure and is more adjustable for matching impedance to have a wider bandwidth. The present invention provides a dual band antenna in order to achieve the foresaid objective.

SUMMARY OF THE INVENTION

In accordance with one respect of the present invention, a dual band antenna is provided. The dual band antenna includes a radiating element, a grounding element and a connecting element. The radiating element has a first radiating portion and a second radiating portion, wherein the second radiating portion extends from the first radiating portion in a first direction parallel to the grounding element. The connecting element extends in a second direction and is connected between the radiating element and the grounding element, wherein the connecting element has a first end connected to the radiating element and a second end connected to the grounding element.

Preferably, the first radiating portion and the connecting element operate in a higher frequency band.

Preferably, the second radiating portion and the connecting element operate in a lower frequency band.

Preferably, the connecting element extending in the second direction forms with the grounding element a first including acute angle between 0° and 90°, and a configuration including the connecting element, the radiating element and the grounding element has a Z-like shape.

Preferably, the grounding element and the connecting element are both connected to a transmission line which is a coaxial cable having an inner core conductor electrically connected to the connecting element and an outer conductor electrically connected to the grounding element.

Preferably, the radiating element further comprises at least one bulge mounted on an edge of the radiating element, and the at least one bulge is adjusted with a bandwidth of the dual band antenna.

Preferably, the radiating element, the grounding element and the connecting element are all mounted on a same plane.

Preferably, the radiating element and the connecting element form a first plane and the grounding element forms a second plane, and the first plane and the second plane have a second including angle therebetween.

In accordance with the aforementioned of the present invention, a dual band antenna is provided. The dual band antenna includes a radiating element, a grounding element, a connecting element and a signal feeding point. The radiating element further comprises a first radiating portion and a second radiating portion extending from the first radiating portion in a first direction parallel to the grounding element. The connecting element extends in a second direction between the radiating element and the grounding element, wherein the connecting element has a first end connected to the radiating element and a second end connected to the grounding element. The signal feeding point is mounted on the connecting element wherein the signal feeding point has a position adjusted with a matching impedance of the dual band antenna.

Preferably, the connecting element extending in a second direction is connected to the grounding element with a first including acute angle between 0° and 90°, and a configuration including the connecting element, the radiating element and the grounding element has a Z-like shape.

Preferably, the grounding element and the connecting element are both connected to a transmission line which is a coaxial cable having an inner core conductor electrically connected to the connecting element and an outer conductor electrically connected to the grounding element.

Preferably, the radiating element further comprises at least one bulge mounted on an edge of the radiating element, and the at least one bulge is adjusted with a bandwidth of the dual band antenna.

Preferably, the radiating element, the grounding element and the connecting element are all mounted on a same plane.

Preferably, the radiating element and the connecting element form a first plane and the grounding element forms a second plane, and the first plane and the second plane have a second including angle therebetween.

In accordance with the aforementioned of the present invention, a dual band antenna is provided. The dual band antenna includes a radiating element, a grounding element and a connecting element. The radiating element has a first radiating portion and a second radiating portion extending from the first radiating portion in a first direction parallel to the grounding element. The connecting element extends in a second direction and is connected between the radiating element and the grounding element, wherein the connecting element has a first end connected to the radiating element and a second end connected to the grounding element with a first including acute angle between 0° and 90°, and a configuration including the connecting element, the radiating element and the grounding element has a Z-like shape.

Preferably, the grounding element and the connecting element are both connected to a transmission line which is a coaxial cable having an inner core conductor electrically connected to the connecting element and an outer conductor electrically connected to the grounding element.

Preferably, the radiating element further comprises at least one bulge mounted on an edge of the radiating element, and the at least one bulge is adjusted with a bandwidth of the dual band antenna.

Preferably, the radiating element, the grounding element and the connecting element are all mounted on a same plane.

Preferably, the radiating element and the connecting element form a first plane and the grounding element forms a second plane, and the first plane and the second plane have a second including angle therebetween.

The foregoing and other features and advantages of the present invention will be more clearly understood through the following descriptions with reference to the drawings, wherein:

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
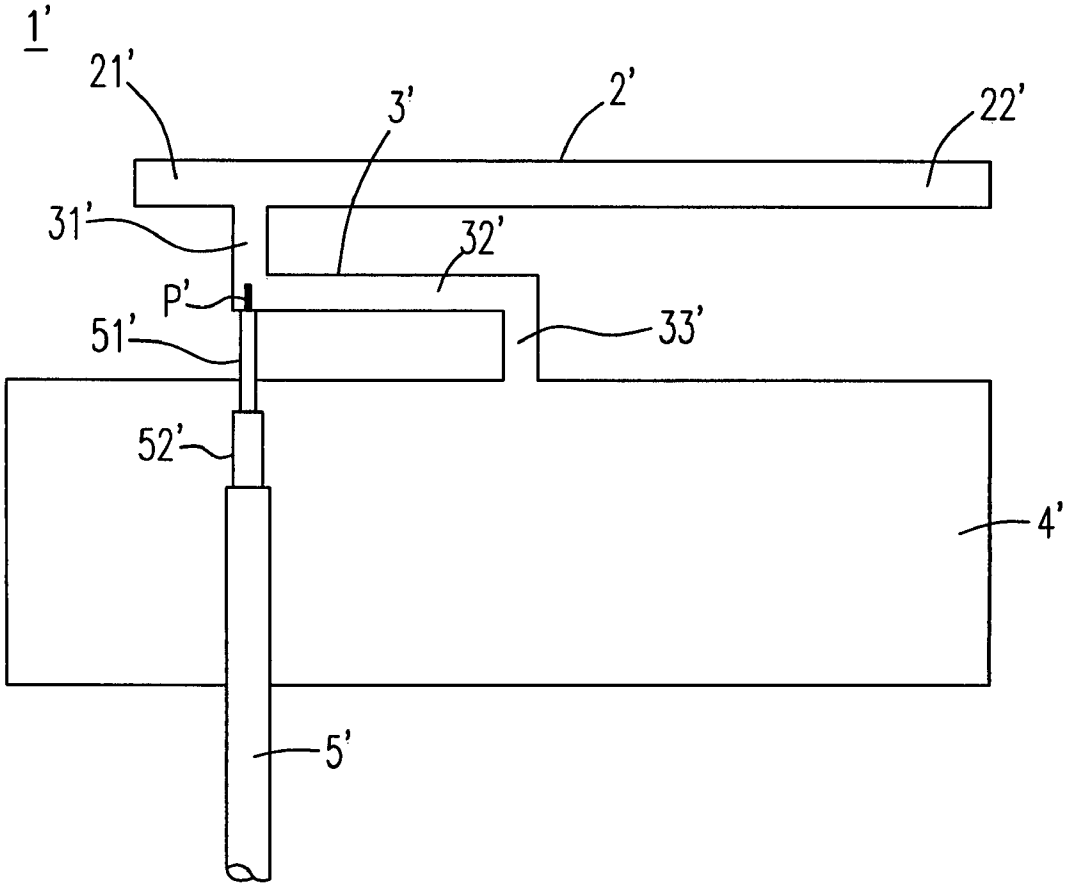
Fig. 1 (PRIOR ART)
FIG. 1 is a top view of a conventional antenna.
Figure 2:
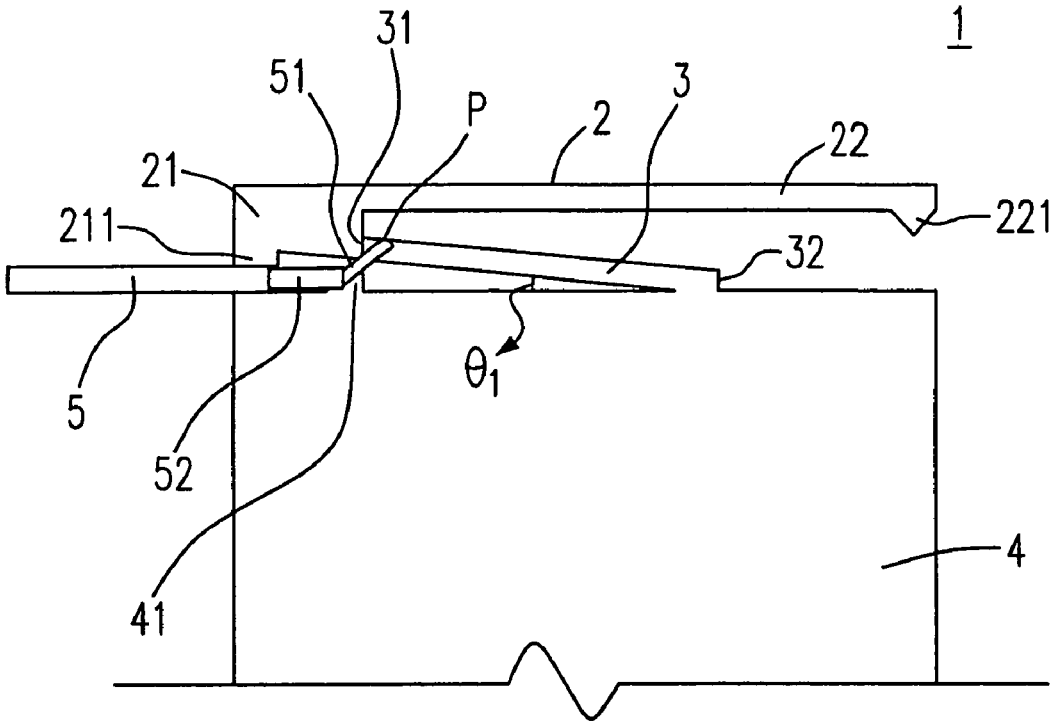
FIG. 2 is a top view of a first embodiment of a dual band antenna of the present invention.

Please refer to FIG. 2, which is a top view of a dual band antenna according to a first embodiment of the present invention. As shown in FIG. 2, the dual band antenna 1 comprises a radiating element 2, a connecting element 3 and a grounding element 4. All these elements are integrated with a strip conductor disposed on a same plane.

The radiating element 2 includes a first radiating portion 21 and a second radiating portion 22. The second radiating portion 22 extends from the first radiation portion 21 in a first direction parallel to the grounding element. The first radiation portion 21 with a trapezoid-like shape has a bulge 211 on the edge of the first radiation portion 21. The second radiating portion 22 with a rectangular shape also has a bulge 221 on the edge of the second radiation portion 22. The bulge 211 and 221 are sized to operate on the frequency bands of the dual band antenna 1. In general, each shape of the bulges may be a triangle, a rectangle, or any other geometric figures. It is allowable not to dispose any bulge on the radiating element 2.

The connecting element 3 extends in a second direction between the radiating element 2 and the grounding element 4, wherein the connecting element 3 has a first end 31 connected to the first radiation portion 21 and a second end 32 connected to the grounding element 4. Between the connecting element 3 and the grounding element 4 is a first including acute angle $\theta_1$ from 0° to 90° (not including 0° and 90°). In the first preferred embodiment, $\theta_1$ is equal to 6°. Hence, the dual band antenna 1 has a configuration including the connecting element 3, the radiating element 2 and the grounding element 4 with a Z-like shape.

The transmission line 5 is a coaxial cable including an inner core conductor 51 and an outer conductor 52. The inner core conductor 51 is soldered on a feeding point P of the connecting element 3, so that the transmission line 5 may transmit signals between the dual band antenna 1 and a radio frequency transceiver (not shown). The outer conductor 52 is soldered on a grounding point 41 of the grounding element 4 for grounding the dual band antenna 1.

Figure 3:
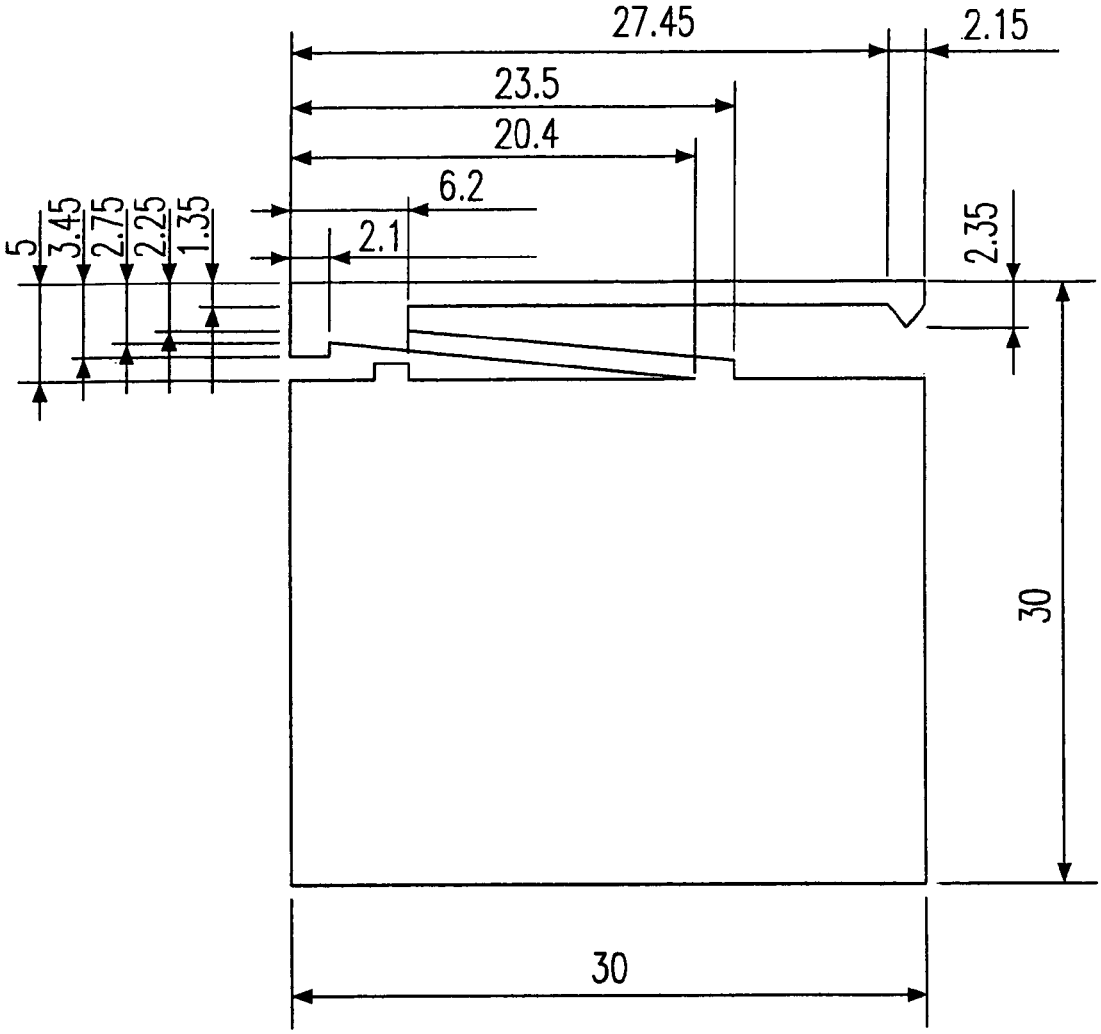
FIG. 3 is a detailed size of the dual band antenna of FIG. 2 without the transmission line.

Please refer to FIG. 3, which shows a detailed size of the dual band antenna 1 of FIG. 2 without the transmission line 5, and the linear unit is millimeter. It is noted that the size of all the elements may be adjusted as matching impedance and resonating in specific frequency bands. Furthermore, the dual band antenna 1 is a metallic conductor. As it is made of tinplate, the thickness is in the range of 0.2 to 0.4 mm. As it is made of copper, the thickness is the same with the copper foils on conventional printed circuits or flexible printing circuits.

Please refer to FIG. 2 again. The signals are inputted from the inner core conductor 51 through the feeding point P to the radiating element 2 and then the radiating element 2 is divided into the first radiating portion 21 and the second radiating portion 22. Hence, the first radiating portion 21 and the connecting element 3 are enabled to function as the planar inverted-F antenna (PIFA) in a higher frequency band ranging from 4.90 to 5.875 GHz. The second radiating portion 22 and the connecting element 3 are also enabling to function as PIFA in a lower frequency band ranging from 2.40 to 2.50 GHz.

Although the invention may be set in a wider frequency band, it is still restricted by the specification of wireless communication standards. For this reason, the preferred embodiments of the invention need to fit the specification for operating and testing the performance of the invention.

Figure 4:
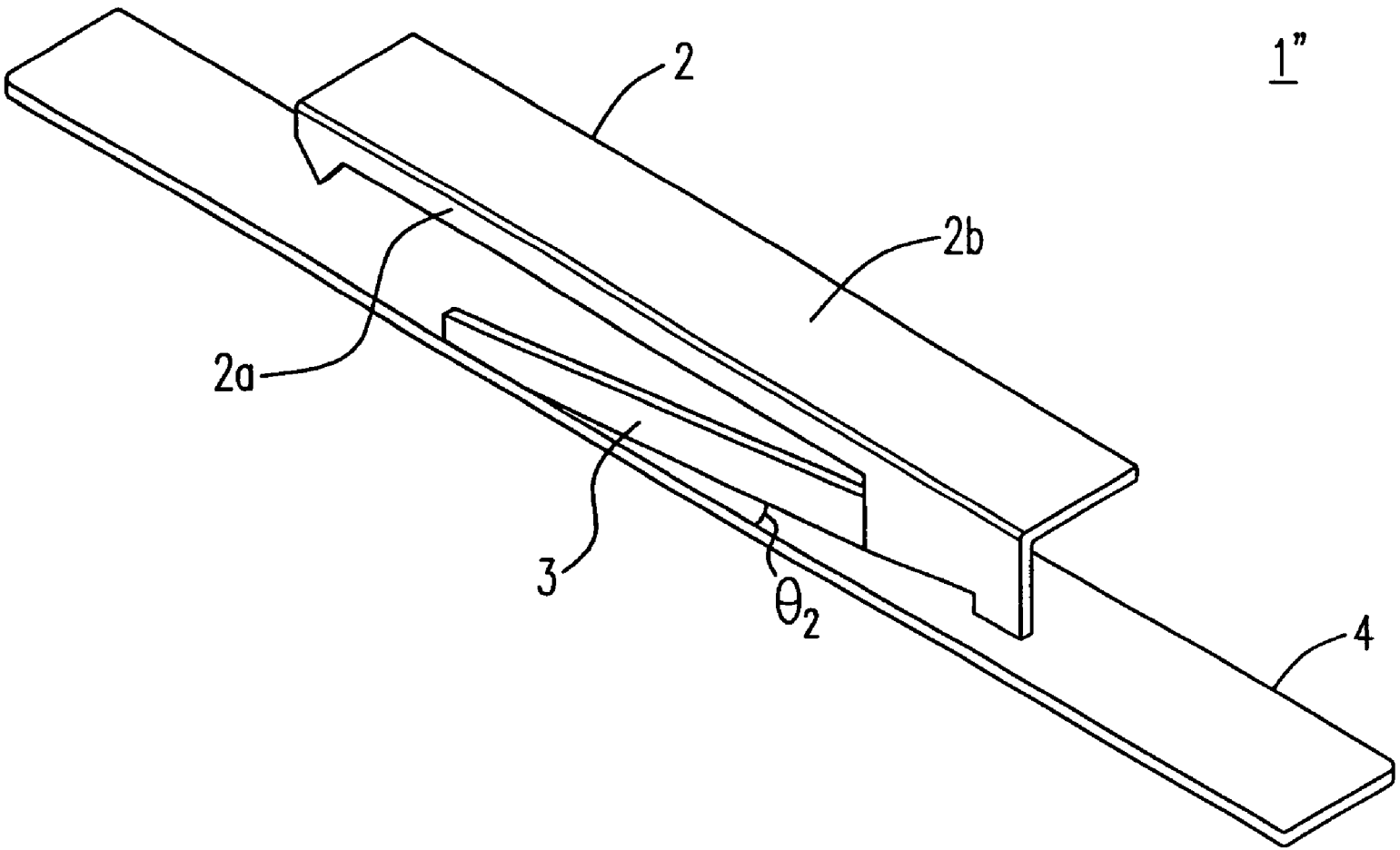
FIG. 4 is a perspective view of a second embodiment of a dual band antenna of the present invention.

Please refer to FIG. 4, which is a perspective view of a dual band antenna 1" according to a second embodiment of the present invention. The dual band antenna 1" has the same operating principle as the dual band antenna 1, but the dual band antenna 1" has a three-dimensional structure.

The dual band antenna 1" includes a radiating element 2, a connecting element 3 and a grounding element 4, wherein the radiating element 2 has a first radiating plane **2*a* and a second radiating plane 2*b*. The second radiating plane 2*b* is perpendicular to the first radiating plane 2*a* and parallel to the grounding element 4. The first radiating plane 2*a* is connected to the second radiating plane 2*b* and the connecting element 3, wherein the first radiating plane 2*a* and the connecting element 3** are both mounted on a same plane.

The connecting element 3 has one end connected to the grounding element 4. Between the connecting element 3 and the grounding element 4 is an interfacial acute angle $\theta_2$ from 0° to 90° (not including 0° and 90°), the same with the dual band antenna 1. The dual band antenna 1" also has a configuration including the connecting element 3, the radiating element 2 and the grounding element 4 with a Z-like shape. Moreover, all elements of the dual band antenna 1" have the same operating principle as the dual band antenna 1.

Figure 5:
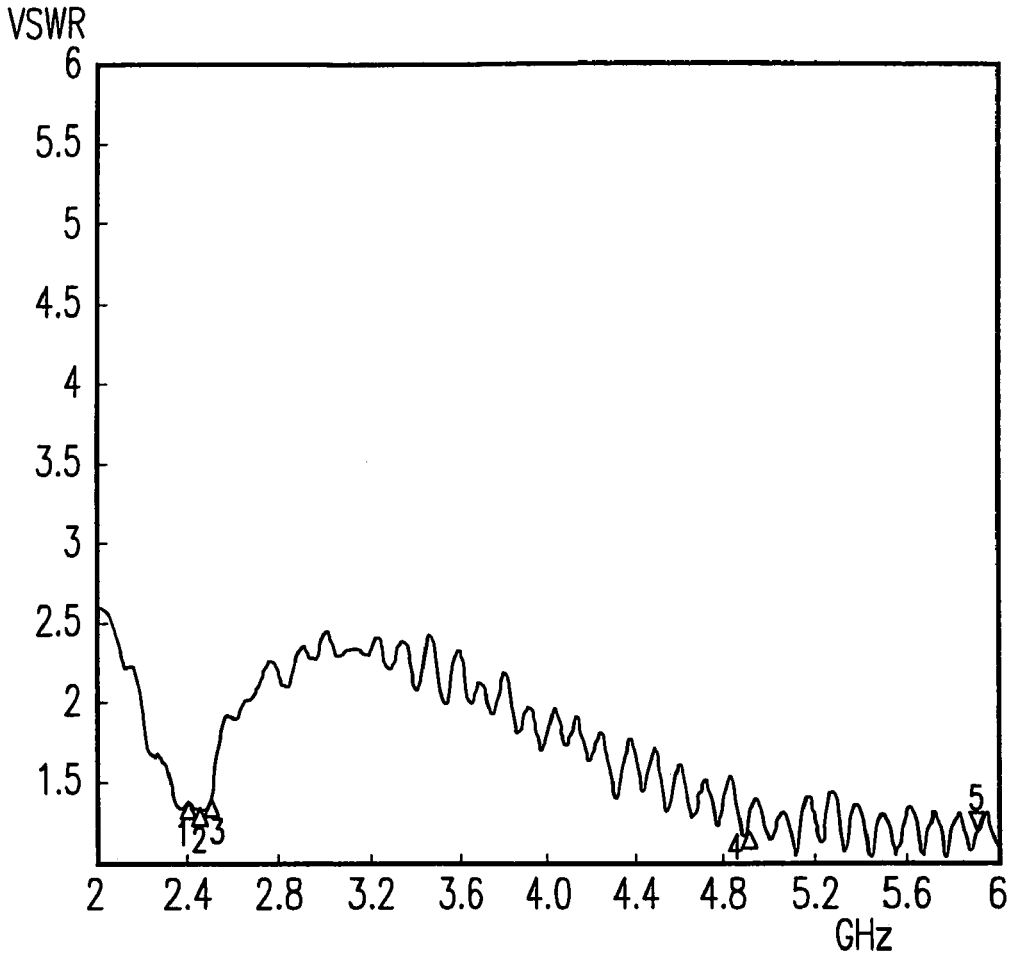
FIG. 5 is a waveform test chart recording for the dual band antenna 1 about Voltage Standing Wave Radio (VSWR) as a function of frequency.

Please refer to FIG. 5, which is a waveform test chart for the dual band antenna 1 about voltage standing wave ratio (VSWR) as a function of frequency. According to FIG. 5, the frequency band of the first radiation portion 21 ranging from 2.40 to 2.50 GHz accords with IEEE's specification of wireless communication standards ranging from 2.412 to 2.4835 GHz. The values of VSWR at point 1 (2.4 GHz), point 2 (2.45 GHz) and point 3 (2.50 GHz) are 1.2396, 1.2351 and 1.2817 severally.

The frequency band of the second radiation portion 22 ranging from 5.15 to 5.9 GHz accords with IEEE's specification of wireless communication standards ranging from 5.15 to 5.85 GHz. The VSWR values at point 4 (4.9 GHz) and point 5 (5.9 GHz) are 1.2825 and 1.1706 respectively. The VSWR values may show the quality of antennas. If the VSWR value increases, the Return Loss will also increase. Generally speaking, it is acceptable that the VSWR values are less than 2 such as Bluetooth, but it is more acceptable that the VSWR values are less than 1.5 to have broader field of operation. Because the dual band antenna 1 has the VSWR values less than 1.3, it certainly has a very perfect performance.

TABLE 1

| | Frequency (GHz) | | | | | | | | | | | |
|---|---|---|---|---|---|---|---|---|---|---|---|---|
| | 2.40 | 2.45 | 2.50 | 4.90 | 5.15 | 5.25 | 5.35 | 5.47 | 5.6475 | 5.725 | 5.825 | 5.875 |
| Peak | −0.41 | 0.32 | −0.83 | −0.72 | 0.98 | 1.51 | 0.98 | 2.49 | 1.00 | 1.36 | 1.53 | 1.35 |
| AVG | −4.14 | −3.98 | −4.55 | −3.93 | −3.17 | −3.48 | −3.15 | −1.09 | −2.93 | −2.34 | −2.12 | −2.49 |

Although VSWR is important, it still needs to use with antenna Gain so as to show an antenna's efficiency more clearly. Please refer to TABLE 1, which shows the antenna Gain of the first embodiment in accordance with the specification of wireless communication standards. The antenna Gain whose unit is dBi includes maximum Gain (Peak) and average Gain (AVG). When the absolute value of antenna Gain increases, it means higher amplitude and less perfect performance. The maximum AVG at 2.40 GHz is −4.14 dBi, the maximum Peak at 5.47 GHz is 2.49 dBi, not to speak of the Peak are less than 2 in the higher frequency band. Hence, the first embodiment of the dual band antenna 1 of this invention is better than the conventional antennas.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claim is:

1. A dual band antenna comprising:

a grounding element extended in a third direction;

a radiating element having a first radiating portion and a second radiating portion, wherein the second radiating portion extends from the first radiating portion in a first direction parallel to the third direction; and a straight connecting element extended in a second direction and connected between the radiating element and the grounding element, wherein the connecting element has a first end connected to the radiating element and a second end connected to the grounding element, the second direction forms with the third direction a first acute angle, and the second direction forms with the first direction a second acute angle.

2. The dual band antenna according to claim 1, wherein the first radiating portion and the connecting element operate in a higher frequency band.

3. The dual band antenna according to claim 1, wherein the second radiating portion and the connecting element operate in a lower frequency band.

4. The dual band antenna according to claim 1, wherein the grounding element and the connecting element are both connected to a transmission line which is a coaxial cable having an inner core conductor electrically connected to the connecting element and an outer conductor electrically connected to the grounding element.

5. The dual band antenna according to claim 1, wherein the radiating element further comprises at least one bulge mounted on an edge of the radiating element, and the at least one bulge is adjusted with a bandwidth of the dual band antenna.

6. The dual band antenna according to claim 1, wherein the radiating element, the grounding element and the connecting element are all mounted on the same plane.

7. The dual band antenna according to claim 1, wherein the radiating element and the connecting element form a first plane and the grounding element forms a second plane, and the first plane and the second plane have a second including angle therebetween.

8. A dual band antenna comprising:

a grounding element;

a radiating element further comprising a first radiating portion and a second radiating portion extended from the first radiating portion in a first direction parallel to the grounding element;

a straight connecting element extended in a second direction between the radiating element and the grounding element, wherein the connecting element has a first end connected to the radiating element and a second end connected to the grounding element, wherein the connecting element is connected to the grounding element with a first acute angle, and is connected to the radiating element with a second acute angle; and a signal feeding point mounted on the connecting element wherein the signal feeding point has a position adjusted with a matching impedance of the dual band antenna.

9. The dual band antenna according to claim 8, wherein the grounding element and the connecting element are both connected to a transmission line which is a coaxial cable having an inner core conductor electrically connected to the connecting element and an outer conductor electrically connected to the grounding element.

10. The dual band antenna according to claim 8, wherein the radiating element further comprises at least one bulge mounted on an edge of the radiating element, and the at least one bulge is adjusted with a bandwidth of the dual band antenna.

11. The dual band antenna according to claim 8, wherein the radiating element, the grounding element and the connecting element are all mounted on the same plane.

12. The dual band antenna according to claim 8, wherein the radiating element and the connecting element form a first plane and the grounding element forms a second plane, and the first plane and the second plane have a second including angle therebetween.

13. A dual band antenna comprising:

a grounding element;

a radiating element having a first radiating portion and a second radiating portion, wherein the second radiating portion extends from the first radiating portion in a first direction parallel to the grounding element; and a straight connecting element extended in a second direction that forms an acute angle with the second radiating portion and the grounding element, wherein the straight connecting element is linearly connected between the first portion of the radiating element and the grounding element, and further wherein the connecting element has a first end connected to the radiating element and a second end connected to the grounding element.

* * * * *